US009927218B1

(12) United States Patent
Schlang

(10) Patent No.: US 9,927,218 B1
(45) Date of Patent: Mar. 27, 2018

(54) FIREARM MAGAZINE HOLDER

(71) Applicant: Richard Jay Schlang, Battle Ground, WA (US)

(72) Inventor: Richard Jay Schlang, Battle Ground, WA (US)

( * ) Notice: Subject to any disclaimer, the term of this patent is extended or adjusted under 35 U.S.C. 154(b) by 95 days.

(21) Appl. No.: 14/475,715

(22) Filed: Sep. 3, 2014

(51) Int. Cl.
*F42B 39/02* (2006.01)
*A45F 5/00* (2006.01)
*A45C 1/04* (2006.01)
*A45F 5/02* (2006.01)

(52) U.S. Cl.
CPC ..... *F42B 39/02* (2013.01); *A45F 5/02* (2013.01); *A45F 5/021* (2013.01)

(58) Field of Classification Search
CPC .... F41A 35/00; A41C 33/0263; F41C 33/048; F45F 5/022; A45F 5/021
USPC ..... 224/230, 239, 268, 269, 666, 182, 194, 224/931; 42/90, 106
See application file for complete search history.

(56) References Cited

U.S. PATENT DOCUMENTS 1,652,972 A * 12/1927 Beck ..... F16B 2/241 24/3.12
1,756,677 A * 4/1930 Cook ..... F42B 39/02 206/3
3,219,244 A * 11/1965 Blask ..... F42B 39/02 221/185
5,351,868 A * 10/1994 Beletsky ..... A45C 11/00 156/220
6,000,589 A * 12/1999 Burdine ..... F41A 9/65 221/185
6,154,997 A * 12/2000 Aluotto ..... F41C 33/02 224/239
6,571,997 B2 * 6/2003 Dedrick ..... A45F 5/00 224/183
6,889,879 B2 * 5/2005 Rivera ..... A45F 5/02 224/245
8,499,986 B2 * 8/2013 Knight ..... A45F 5/021 224/197
8,631,980 B2 * 1/2014 Youssefi-Shams ..... A45F 5/02 224/197
9,016,531 B2 * 4/2015 Paugh ..... A45F 5/004 224/162
9,072,363 B2 * 7/2015 Paugh ..... A45F 5/004
9,170,064 B2 * 10/2015 Rogers ..... F41A 35/00
9,182,205 B2 * 11/2015 Sitz ..... F41A 23/18
2013/0270311 A1 * 10/2013 Sitz ..... F41A 23/18 224/255
2013/0306693 A1 * 11/2013 Prestwich ..... A45F 5/00 224/269
2014/0103083 A1 * 4/2014 Sitz ..... F42B 39/08 224/255
2014/0150315 A1 * 6/2014 Russell ..... F41A 9/65 42/50

* cited by examiner

*Primary Examiner* — Nathan J Newhouse
*Assistant Examiner* — Lester L Vanterpool
(74) *Attorney, Agent, or Firm* — Underwood & Associates, LLC

(57) ABSTRACT

Systems and methods for carrying a firearm magazine are disclosed. More specifically, an apparatus and method for substantially securely carrying a firearm magazine substantially concealed in a clothing pocket is provided.

20 Claims, 6 Drawing Sheets

FIREARM MAGAZINE HOLDER

TECHNICAL FIELD

This disclosure relates to systems and methods for carrying a firearm magazine on a person. More specifically, this disclosure relates to systems and methods for carrying a firearm magazine substantially concealed in a clothing pocket.

BACKGROUND

Security personnel, police officers, military personnel, and other personnel (including private citizens) who carry a firearm may carry a number of items to accompany their firearm and/or assist in their security and protection on a duty belt and/or concealed upon their person. Such items may include a holster for a firearm, a magazine or speed-loader pouch or holder for holding extra ammunition for the firearm, and holders for other items such as mace or pepper spray, a baton, handcuffs, a flashlight, a knife, a radio, a cellular phone, or other items useful to such personnel. As mentioned, one or more of the carried items may be concealed.

Such holders have been made of leather. Leather has been a desirable material because of its durability and appearance. However, leather holders have several disadvantages. For instance, leather is a relatively heavy material, and it may absorb oils or grease causing stains. Even more problematic, leather can be easily contaminated with blood, which in turn is very difficult to remove from the holder. Blood contamination is particularly problematic for police officers who come in contact with injured victims of vehicle accidents and crimes.

In particular for concealed carry, there is a need for a magazine holder that may be worn, for example, inside a pocket that may substantially securely hold the firearm magazine in a concealed fashion while also allowing reasonable access to the magazine. Accordingly, it would be advantageous to provide a magazine holder or the like of a type disclosed in the present application that provides any one or more of these or other advantageous features, including, but not limited to improved structure, configuration, and method to conceal, store, and provide a firearm magazine when the firearm magazine is needed.

SUMMARY

In one exemplary aspect, a firearm magazine holder (hereinafter "magazine holder") is disclosed. The magazine holder comprises a back, at least one side coupled to the back, a front coupled to the at least one side, and a bottom coupled to the back, the at least one side, the front, or a combination thereof; a retainer coupled to the back; and a catch coupled to the back adjacent the retainer. In one embodiment, the magazine holder further includes a retainer attachment to couple the retainer to the back. In one embodiment, the magazine holder further includes a rotating retainer attachment to couple the retainer to the back and to allow rotation between the retainer and the back. In one embodiment, the retainer and the catch are configured to detachably engage a garment layer. In one embodiment, the retainer is configured to detachably engage a first side of a garment layer and the catch is configured to detachably engage a second side of the garment layer. In a related embodiment, the retainer is configured to detachably engage the first side of the garment layer and the catch is configured to detachably engage the second side of the garment layer at substantially a same region of the garment layer. In one embodiment, the catch further includes one or more protrusions, extensions, textures, features, and/or a combination thereof coupled to the back. In one embodiment, the catch further includes one or more protrusions, extensions, textures, features, and/or a combination thereof substantially integrally formed with the back. In a related embodiment, at least one or more of the protrusions further include a substantially triangular protrusion.

In one exemplary aspect, a method for making a concealment article for a firearm magazine is provided. The method includes providing a back, at least one side coupled to the back, a front coupled to the at least one side, and a bottom coupled to the back, the at least one side, the front, or a combination thereof to form the concealment article configured for the firearm magazine. The method further includes coupling a retainer to the back. The method further includes coupling a catch to the back, adjacent the retainer.

In one exemplary aspect, a method of holding a firearm magazine is provided. The method includes inserting the firearm magazine into a magazine holder, the magazine holder including a retainer and a catch adjacent the retainer. The method further includes inserting the magazine holder including the firearm magazine into a garment pocket. The method further includes detachably engaging the garment pocket with the retainer and the catch. In one embodiment, the method further includes rotating the retainer away from the catch before inserting the magazine holder into the garment pocket, and rotating the retainer back to adjacent the catch after inserting the magazine holder into the garment pocket. In one embodiment, the method further includes detachably engaging the garment pocket with the retainer and the catch in substantially the same location.

In one exemplary aspect, a concealable firearm magazine holder is disclosed. The concealable firearm magazine holder includes a back, at least one side, a front, and a bottom; a magazine cavity defined by the back, the at least one side, the front, and the bottom; a clip rotationally coupled to the back; and a catch protruding from the back adjacent the clip. In one embodiment, the clip and the catch are configured to detachably engage a garment pocket in substantially the same location. In one embodiment, the magazine cavity is configured to accept a firearm magazine inserted therein; the magazine cavity is further configured to substantially fully enclose an ammunition cartridge removably inserted into the firearm magazine. In one embodiment, the concealable firearm magazine holder is formed from aluminum, glass fiber reinforced plastic, a glass fiber reinforced polymer, a carbon fiber reinforced plastic, a carbon fiber reinforced polymer, a plastic, a polymer, KYDEX, or a combination thereof. In one embodiment, at least the back and the catch are integrally formed. In a related embodiment, the catch further includes at least one substantially triangular protrusion. In yet another related embodiment, the catch further includes at least one substantially triangular protrusion having an edge that is substantially perpendicular to the back.

Advantages of these and other aspects and embodiments are set forth in the description that follows. Additional advantages may be realized by practice of one or more embodiments described herein or by modification thereof. The advantages of these and other embodiments may be realized and attained by means of the instrumentalities and combinations particularly pointed out in the appended claims. Further benefits and advantages of these and other embodiments will become apparent from consideration of the following detailed description given with reference to the accompanying drawings that specify and show preferred embodiments of the magazine holder.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be limiting in any way. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which.

DETAILED DESCRIPTION OF ILLUSTRATIVE EMBODIMENTS

Figure 3:
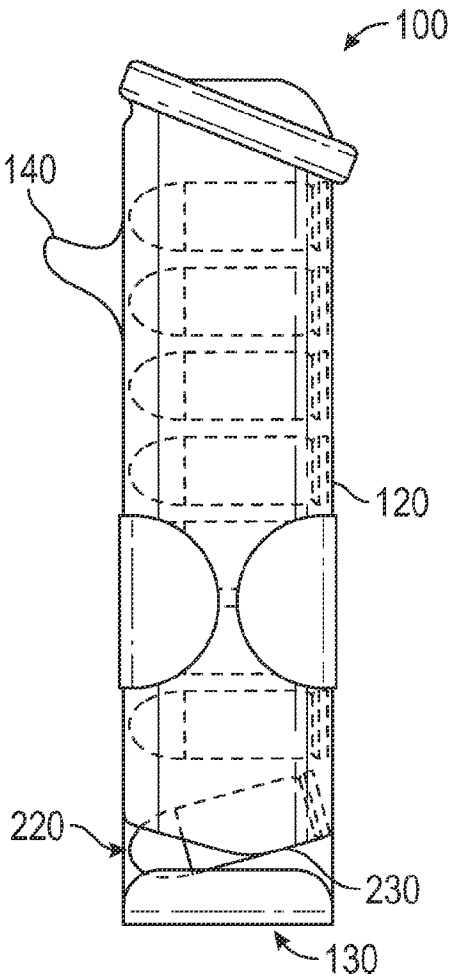
FIG. 3 illustrates the exposed cartridge of the prior art magazine holder of FIGS. 1 and 2.

Turning now descriptively to the drawings, in which similar reference characters denote similar elements throughout the several views, the figures illustrate the net assembly of the present invention. With regard to the reference numerals used, the following numbering is used throughout the various drawing figures:

100 prior art magazine holder
110 magazine holder back
120 magazine holder side
130 magazine holder bottom
140 magazine holder catch
200 magazine holder clip
210 magazine holder clip attachment
220 exposed ammunition cartridge
230 exposed bullet
300 magazine holder
310 magazine holder back
315 magazine holder back front side
320 magazine holder front
330 magazine holder side
340 magazine holder bottom
350 magazine holder retainer attachment
360 magazine cavity
400 magazine holder catch
425 magazine holder catch (alternative embodiment)
430 magazine holder catch (alternative embodiment)
500 magazine holder retainer
510 magazine holder back rear side
591 detachable upper plate member
592 saw-toothed edge (plate member)
593 saw-toothed edge (magazine holder back)
594 slot (plate member)
595 slot (magazine holder back)
596 spring
597 spring
598 bolt
599 nut
600 magazine
610 magazine floor plate
800 garment pocket
810 garment pocket seam When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein may be shown and described. It will, of course, be appreciated that in the development of any such actual implementation, numerous implementation-specific decisions must be made in order to achieve the developer's specific goals, such as compliance with application-and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In one general aspect, a firearm magazine holder is disclosed. More specifically, a firearm magazine holder is disclosed that can removably secure a firearm magazine, in particular a pistol or handgun magazine, in a concealed fashion. In one embodiment, the firearm magazine can be a spare or additional magazine, for example a spare or additional magazine to the magazine coupled to and/or loaded into the pistol or handgun. Further, though described with reference to a pistol or handgun magazine, it is to be understood that an embodiment may be configured to hold any type of firearm magazine. For example, in addition to a pistol or handgun magazine, an embodiment may be configured to hold a rifle magazine utilizing pistol or handgun caliber ammunition, a rifle magazine utilizing rifle caliber ammunition, or any other firearm magazine. Moreover, because spare magazines are often times utilized during extreme life-threatening and/or combat situations, the firearm magazine holder of an embodiment may allow substantially rapid and easy access to a full spare or additional magazine for reloading and resuming fire with minimal delay. Furthermore still, the principles of the firearm magazine holder disclosed herein can be used to similarly accommodate concealment of a variety of other personal defense systems in addition to firearms; for example, a firearm holder described herein can be modified to accommodate batons, sprays (e.g., pepper spray), mace, or other systems.

For example, the firearm magazine holder of an embodiment, in addition to substantially securely holding the firearm magazine, may enable the release, access, and acquisition of a spare or additional firearm magazine with the non-firing free hand, while substantially maintaining a grip on the firearm with the firing hand. For this reason, the firearm magazine holder of an embodiment may be removably mounted to and/or fastened on a belt, vest, or other garment worn by the user, where it may be within easy reach of the user's free hand. Specifically, the firearm magazine holder of an embodiment may be inserted into and removably attached to a pocket of a garment worn by the user. For example, the firearm magazine holder of an embodiment may be inserted into and removably attached to a pants pocket. In particular, the pants pocket may be a front pocket of a pair of jeans.

Figure 2:
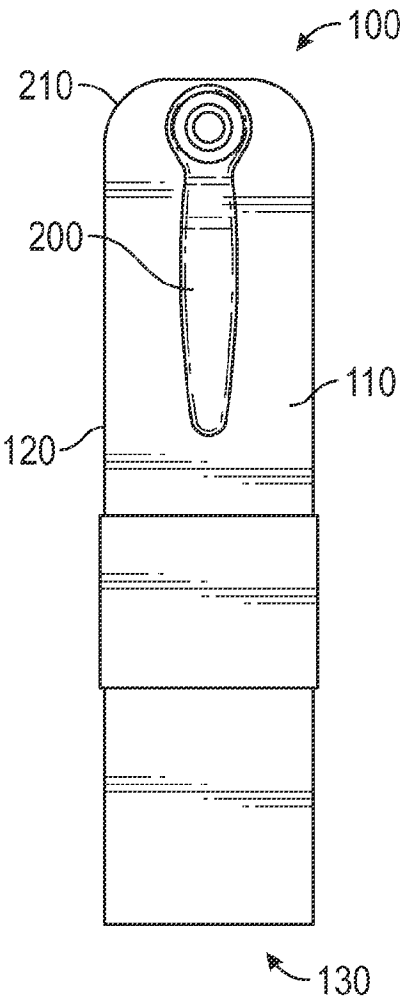
FIG. 2 illustrates the back view of the prior art firearm magazine holder of FIG. 1.
Figure 1:
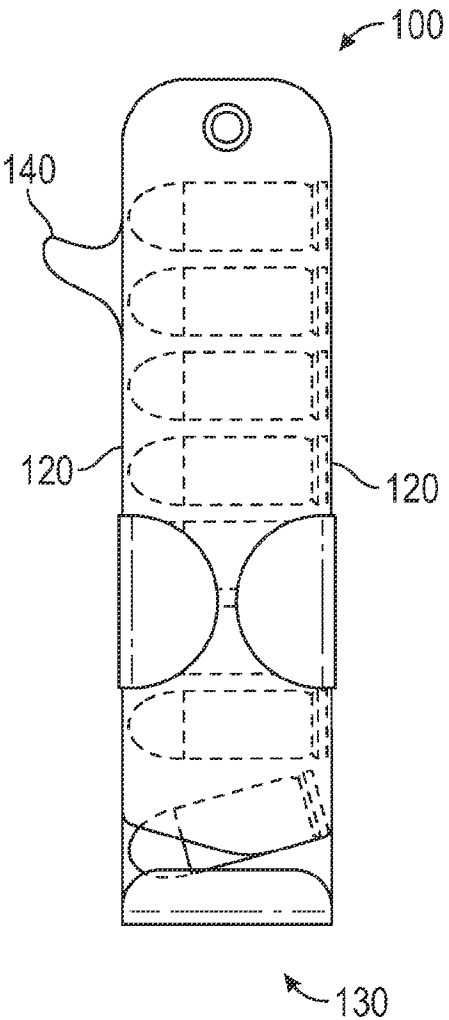
FIG. 1 illustrates the front view of a prior art firearm magazine holder.
Figure 4:
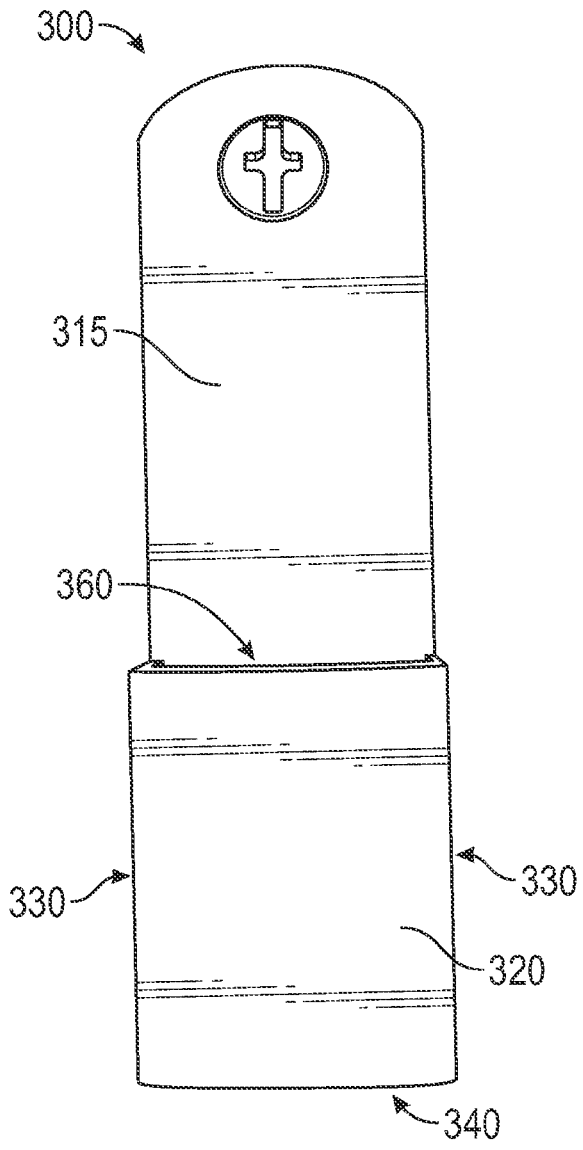
FIG. 4 illustrates a front-elevation view of a concealable firearm magazine holder according to one embodiment.

FIGS. 1 and 2 illustrate a prior art magazine holder 100 including a magazine holder back 110, magazine holder side 120, and magazine holder bottom 130. The magazine holder back 110, magazine holder side 120, and magazine holder bottom 130 may hold a firearm magazine as illustrated in FIG. 3. Coupled to and/or extending from the magazine holder side 120 is magazine holder catch 140. The magazine holder catch 140 may engage the side of a pocket into which the prior art magazine holder 100 is inserted.

FIG. 2 further illustrates the magazine holder clip 200 coupled to the prior art magazine holder back 100 with a magazine holder clip attachment 210. The magazine holder clip 200 may extend over and engage, for example, a surface of a pocket into which the prior art magazine holder 100 is inserted. Importantly, the magazine holder catch 140 and the magazine holder clip 200 engage different surfaces of the pocket into which the magazine holder 100 is inserted. Further, as the magazine holder catch 140 is only provided on one side of the prior art magazine holder 100, the prior art magazine holder 100 may not operate as effectively in, for example, pockets on different sides. More specifically, the single magazine holder catch 140 may only engage, for example, a right pocket or a left pocket to substantially secure the prior art magazine holder 100 to the pocket. Accordingly, if the prior art magazine holder 100 is inserted into a pocket with substantially the opposite orientation, the magazine holder catch 140 may not engage the pocket at all, in which case the prior art magazine holder 100 may fail to remain in the pocket when a magazine (not illustrated) is removed from therein. Further, the shape and configuration of the magazine holder catch 140 may cause the magazine holder catch 140 to easily break or otherwise disengage from the pocket into which the prior art magazine holder 100 is inserted.

Further, as illustrated by FIG. 3, the prior art magazine holder 100 may not cover and/or contain a bullet loaded in a magazine contained in the prior art magazine holder 100. Specifically, FIG. 3 illustrates an exposed ammunition cartridge 220 and an exposed bullet 230. For at least the reasons that will be described below with reference to magazine cavity 360, this lack of bullet protection and/or containment may cause one or more problems ranging from inconvenience to pistol malfunction and ammunition cartridge shortage that could significantly threaten the safety of the shooter. In short, for at least these reasons, the prior art magazine holder 100 may fail in particular during repeated use and/or use under stress or duress that may accompany the need for a spare or additional firearm magazine.

Referring now to FIGS. 4-7, a concealable firearm magazine holder 300 is illustrated according to one embodiment. More specifically, as shown in FIGS. 4-7, the magazine holder 300 of an embodiment generally comprises a magazine holder back 310, one or more magazine holder sides 330 coupled to the magazine holder back 310 and a magazine holder front 320 coupled to the one or more magazine holder sides 330. A magazine holder bottom 340 may further couple to magazine holder back 310, one or more magazine holder sides 330, and the magazine holder front 320. The magazine holder back 310 of an embodiment may further include a magazine holder retainer attachment 350 to couple to a magazine holder retainer 500 as will be described in further detail with reference to, e.g., FIG. 6.

Figure 5:
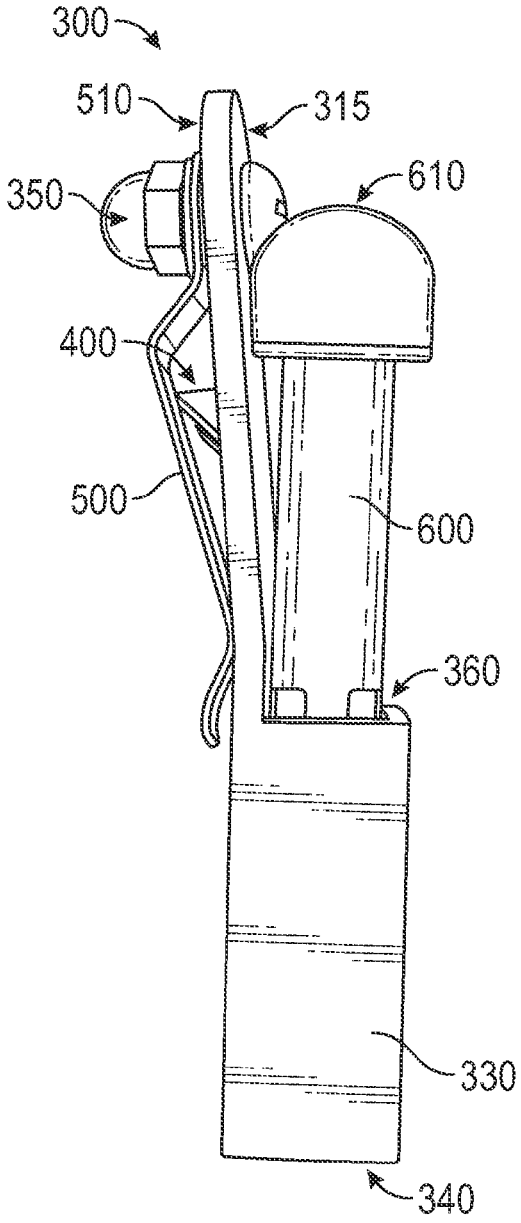
FIG. 5 illustrates a side-elevation view of the concealable firearm magazine holder of FIG. 4.
Figure 5A:
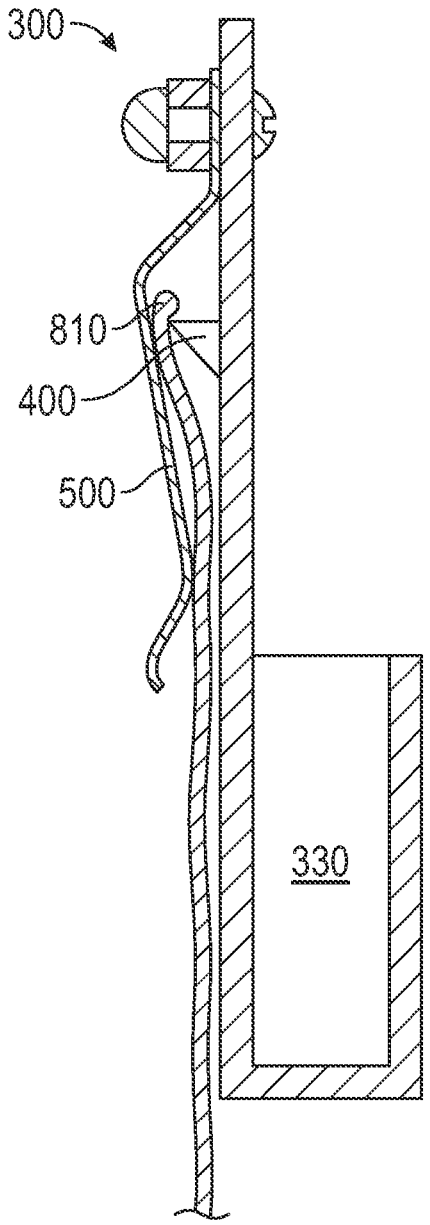
FIG. 5A illustrates a side-elevation view of the concealable firearm magazine holder of FIG. 4 engaged with fabric of a clothing pocket.
Figure 6:
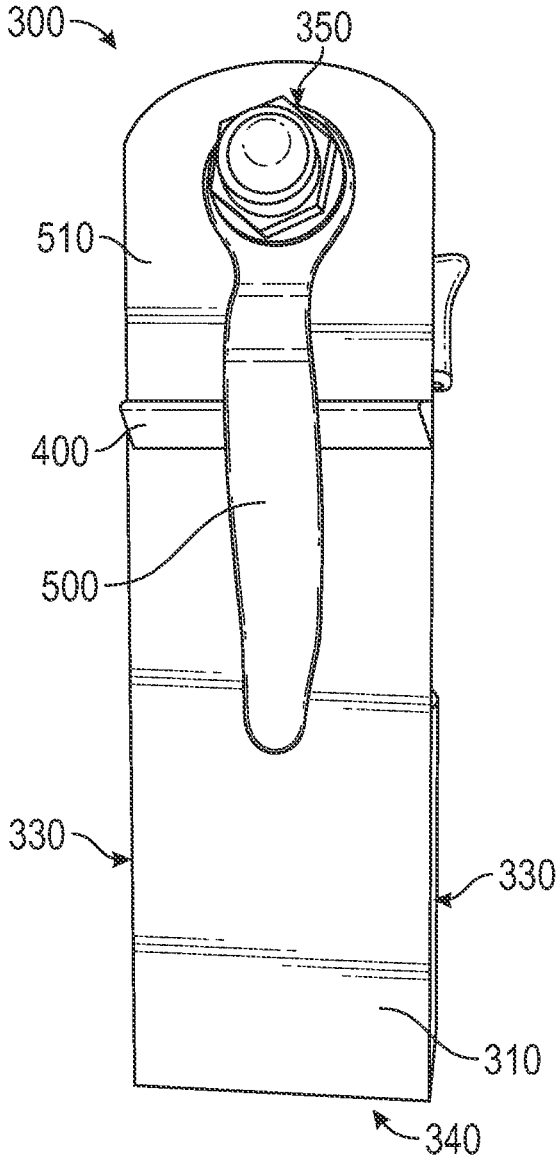
FIG. 6 illustrates a back-elevation view of the concealable firearm magazine holder of FIG. 4.
Figure 7:
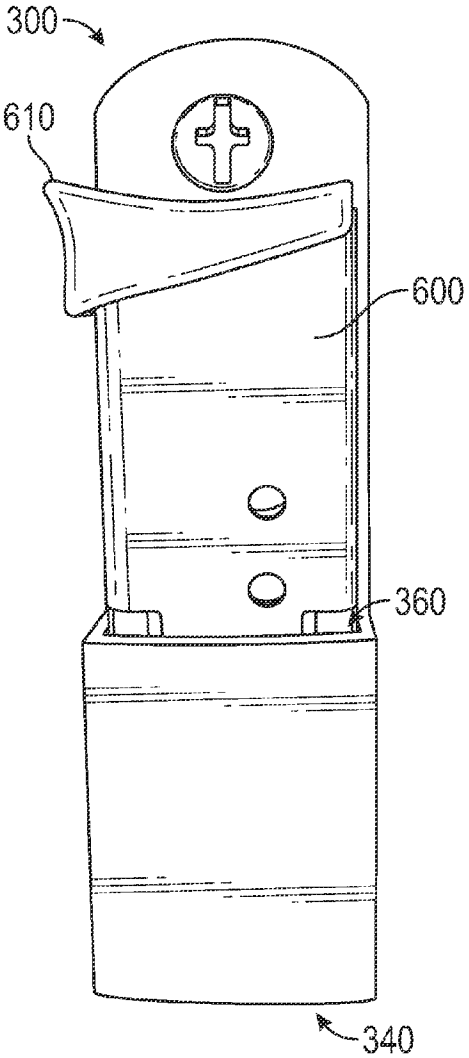
FIG. 7 illustrates a front-elevation view of the concealable firearm magazine holder of FIG. 4, including a firearm magazine disposed therein.

As further illustrated by FIG. 6, the magazine holder back 310 of an embodiment may further include a front side 315 and a rear side 510. The magazine holder back front side 315, one or more magazine holder sides 330, the magazine holder front 320, and the magazine holder bottom 340 may define a magazine cavity 360 into which a magazine 600 (as illustrated by FIGS. 5 and 7) may be removably inserted.

In one embodiment, the magazine holder back front side 315, two magazine holder sides 330 (e.g., a left side and a right side), the magazine holder front 320, and the magazine holder bottom 340 may substantially enclose the magazine cavity 360. More specifically, an ammunition cartridge (not illustrated) contained in the magazine 600 that is removably inserted into the magazine cavity 360 may be substantially fully enclosed and protected on all sides. This serves multiple purposes. First, a bullet and a primer included in the ammunition cartridge may be substantially protected from contact. More specifically, the bullet and/or the primer may be protected from contacting other items that may be located, for example in the same pocket into which the magazine holder 300 of an embodiment is removably inserted. This may substantially prevent the bullet from being damaged. This is important in particular for hollow point bullets for which a nick, burr, or other damage may decrease the bullet's performance and/or reliability, in particular for relatively steep feed ramps common to small semiautomatic pistols.

Further, the substantially enclosed magazine cavity 360 of an embodiment may prevent an item in the pocket along with the magazine holder 300 from striking and thereby igniting the primer and firing the cartridge. Further still, the substantially enclosed magazine cavity 360 may prevent contact with a cartridge in the magazine 600 that may alter the location of the cartridge within the magazine 600. A misaligned cartridge in magazine 600 may impede loading the magazine 600 into a pistol, may cause the cartridge to improperly chamber and/or jam, and/or otherwise cause a pistol malfunction. A significantly misaligned cartridge may further be ejected or expelled from the magazine 600 causing, among other possible issues, grave danger to the pistol user if he or she depends on the magazine 600 capacity and/or accurate knowledge of the magazine 600 capacity for their own or others' safety.

Figure 8:
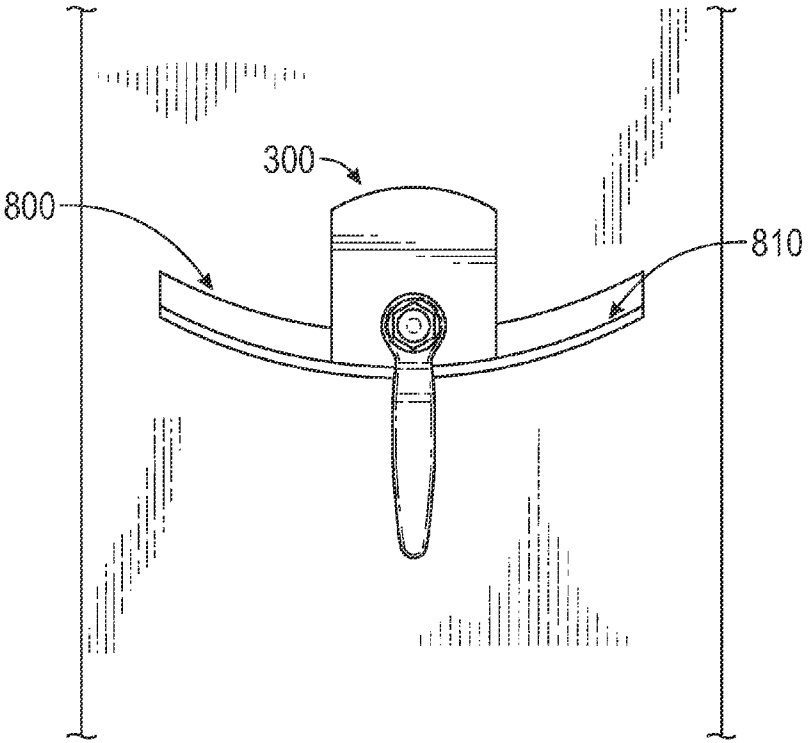
FIG. 8 illustrates one embodiment of a concealable firearm magazine holder disposed in a clothing pocket.

In one embodiment, the magazine holder retainer 500 may further couple to the magazine holder back 310 with magazine holder retainer attachment 350. In an embodiment, the magazine holder retainer 500 may be a clip or similar retaining element to clip onto and releasably attach the magazine holder 300 to, for example, a garment pocket 800 into which the magazine holder 300 is inserted as illustrated by FIG. 8. More specifically, the magazine holder retainer 500 may be configured and/or shaped to resemble the clip common to pocket knives and other commonly carried pocket tools and instruments. By resembling a substantially common clip, the magazine holder retainer 500 of an embodiment may contribute to the concealment of the magazine holder 300 to which it is coupled. The configuration and/or shape of the magazine holder retainer 500 of an embodiment may further assist the insertion of the magazine holder 300 into the garment pocket 800 and removable attachment thereto, for example substantially without damaging the garment pocket 800 and/or garment pocket seam 810

In one embodiment, the magazine holder retainer 500 can be coupled to the magazine holder back 310 at least partially above the location of the magazine end plate 610 of magazine 600 when magazine 600 is substantially fully inserted into the magazine cavity 360. The location of the magazine holder retainer 500, and further the location of the magazine holder retainer attachment 350 on the magazine holder back 310 may at least in part determine the depth to which the magazine holder 300 may fit within the garment pocket 800. Along those lines, the length to which the magazine holder back 310 may extend above the location of the magazine end plate 610 may facilitate the location of the magazine holder retainer attachment 350 and the magazine holder retainer 500 coupled thereto. The length and configuration of the magazine holder back 310, the location of the magazine holder retainer attachment 350 and the magazine holder retainer 500 coupled thereto, and/or a combination thereof may accordingly be adjusted so that the magazine 600 may be substantially concealed within the garment pocket 800 while remaining substantially accessible to the user.

As discussed above, the magazine holder retainer attachment 350 may couple the magazine holder retainer 500 to the magazine holder 300 of an embodiment, and in particular to the magazine holder back 310. In an embodiment, the magazine holder retainer attachment 350 may extend from the magazine holder back front side 315 through to the magazine holder back rear side 510 to substantially securely attach the magazine holder retainer 500 to the magazine holder 300. For example, the magazine holder retainer attachment 350 of an embodiment may include a rivet, a bolt and nut, a screw, or any other similar threaded or unthreaded attachment means. Alternately, the magazine holder retainer attachment 350 may include a clamp, collar, ring, or other similar attachment means that may extend at least in part around the magazine holder back 310 instead of and/or in addition to extending through the magazine holder back 310. The embodiments are not limited in this context.

In an embodiment, the magazine holder retainer attachment 350 and the magazine holder retainer 500 may be formed substantially separately. Alternately, the magazine holder retainer attachment 350 and the magazine holder retainer 500 may be at least partially integrally formed. Further, the location of the magazine holder retainer attachment 350 may be adjustable, for example, along and/or within the magazine holder back 310 to adjust the location of the magazine holder retainer 500. For example, the magazine holder retainer attachment 350 may be adjustable to adjust the location of the magazine holder retainer 500 toward the magazine cavity 360 or away from the magazine cavity 360 thereby adjusting the depth to which the magazine holder 300 may couple to and extend into the garment pocket 800. Said differently, the magazine holder retainer attachment 350 may be adjustable so that the magazine holder 300 of an embodiment may sit higher or lower in, for example, the garment pocket 800. The magazine holder retainer attachment 350 may be further adjustable to adjust the lateral location or position of the magazine holder retainer 500 coupled thereto.

Further still, the magazine holder retainer attachment 350 may allow and/or be adjustable to selectively allow, mitigate, and/or substantially prevent rotation of the magazine holder retainer 500 with reference to the magazine holder 300. As will be explained below in more detail, the selective rotation of the magazine holder retainer 500 may facilitate the operation of the magazine holder 300. In particular, the selective rotation of the magazine holder retainer 500 may improve the ability with which the magazine holder 300 of an embodiment may removably couple to the garment pocket 800.

Referring in particular to FIGS. 5, 5A, 6, and 8, the magazine holder catch 400 of an embodiment may include one or more protrusions, extensions, textures, features, and/or a combination thereof, coupled to the magazine holder 300 to improve the ability with which the magazine holder 300 may removably couple to the garment pocket 800 into which the magazine holder 300 may be inserted. More specifically, the magazine holder catch 400 of an embodiment may engage the garment pocket 800 to increase the strength with which the magazine holder 300 may removably couple to the garment pocket 800 to substantially prevent the inadvertent or unintentional extrusion and/or removal of the magazine holder 300 from the garment pocket 800. The magazine catch 400 of an embodiment may further substantially engage the garment pocket seam 810 to further increase the strength with which the magazine holder 300 may removably couple to the garment pocket 800 to substantially prevent the inadvertent or unintentional extrusion and/or removal of the magazine holder 300 from the garment pocket 800.

More specifically, the magazine holder retainer 500 and the magazine holder catch 400 may interoperate at least in part to substantially prevent the inadvertent or unintentional extrusion and/or removal of the magazine holder 300 from the garment pocket 800. In particular, the magazine holder retainer 500 and the magazine holder catch 400 may both at least in part engage the same layer of the garment pocket 800. For example, the magazine holder retainer 500 may at least in part engage the front side of a garment pocket 800 surface while the magazine holder catch 400 may at least in part engage the back side of the same garment pocket 800 layer. In an embodiment, the location on the front side of the garment pocket 800 layer to which the magazine holder retainer 500 may engage may at least partially overlap the location on the back side of the garment pocket 800 layer to which the magazine holder catch 400 may engage. In an embodiment, the overlap may be a substantial overlap such that the garment pocket 800 layer may be substantially pinched or otherwise engaged substantially between the magazine holder retainer 500 and the magazine holder catch 400. In an embodiment, the substantial overlap may further at least partially include the garment pocket seam 810.

Figure 9:
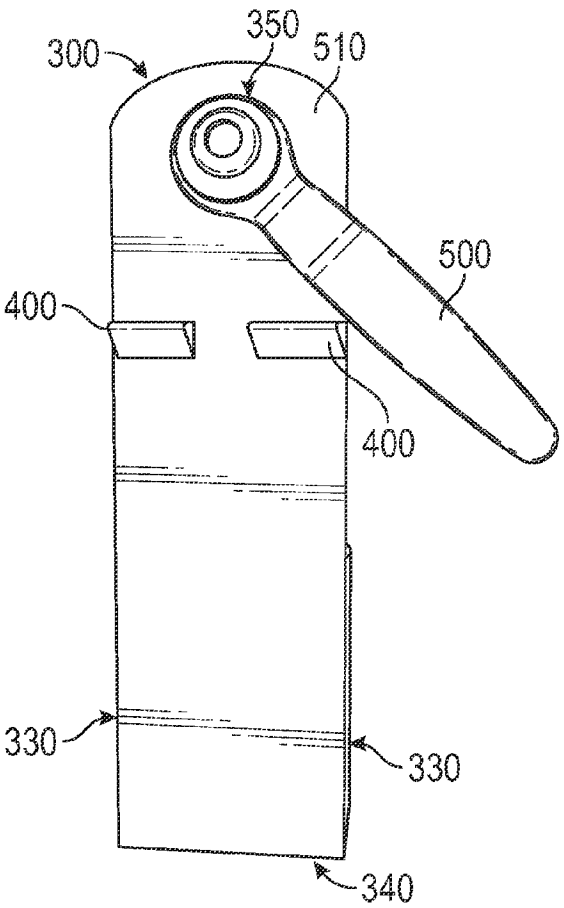
FIG. 9 illustrates a back-elevation view of a concealable firearm magazine holder according to one embodiment.

Referring to FIG. 8, as described above, the magazine holder catch 400 of embodiments may engage the garment pocket 800 adjacent the magazine holder retainer 500. The shape of the magazine holder catch 400 may be configured to, for example, allow the insertion of the magazine holder 300 into the garment pocket 800 while substantially holding the magazine holder 300 in place once inserted. More specifically, the magazine holder catch 400 may allow the insertion of the magazine holder 300 over the garment pocket seam 810 (for example as illustrated by FIG. 9) while substantially impeding the removal of the magazine holder 300 over the same garment pocket seam 810. Said differently, the magazine holder catch 400 may be configured for a substantially one-way insertion of the magazine holder 300 into the garment pocket 800. While the magazine holder 300 may be subsequently withdrawn and removed from the garment pocket 800, the withdrawal and removal may be more difficult and/or may require more interaction or more manipulation of the magazine holder 300. As such, the magazine holder 300 may not be inadvertently removed from the garment pocket 800. At the same time, the magazine holder catch 400 may not engage the garment pocket 800 and/or garment pocket seam 810 to such a level that intentional removal of the magazine holder 300 from the garment pocket 800 may cause damage to the garment pocket and/or garment pocket seam 810.

To accomplish the substantially secure engagement of the magazine holder 300 with the garment pocket 800 and/or garment pocket seam 810, the magazine holder catch 400 may have a variety of different shapes and/or configurations. For example, in an embodiment, the magazine holder catch 400 may be a single protrusion from the magazine holder back rear side 510. In an embodiment, the protrusion may be adjacent the magazine holder retainer 500. More specifically, the magazine holder catch 400 may protrude from the magazine holder back rear side 510 at least in part from between the magazine holder retainer 500 and the magazine holder back 310. In an embodiment, the magazine holder catch 400 may include multiple (e.g., two or more) protrusions from the magazine holder back rear side 510 with one or more gaps formed and/or interposed between the multiple protrusions. For example, the magazine holder catch 400 may include two protrusions with a gap interposed between the two protrusions. Further, in an embodiment, the gap may be located substantially adjacent the magazine holder retainer 500. More specifically, the gap may be substantially laterally centered on the magazine holder retainer 500. With such a shape and/or configuration, the magazine holder catch 400 may allow the magazine holder 300 to be inserted into the garment pocket 800 while simultaneously substantially preventing its inadvertent removal from the garment pocket 800 and/or damage to the garment pocket 800 and/or garment pocket seam 810.

The magazine holder catch 400 of an embodiment may have an approximately triangular cross sectional shape. The magazine holder catch 400 of a further embodiment may have a substantially right-triangular cross sectional shape. More specifically, at least one surface of the magazine holder catch 400 may protrude from the magazine holder back rear side 510 substantially perpendicularly. In an embodiment, the top surface of the magazine holder catch 400 may protrude from the magazine holder back rear side 510 substantially perpendicularly while the bottom surface of the magazine holder catch 400 may protrude from the magazine holder back rear side 510 at an angle less than 90 degrees. In an embodiment, the angle may be approximately between 25 and 65 degrees. In a further embodiment, the angle may be approximately 45 degrees. With such a shape and/or configuration, the magazine holder catch 400 may allow the magazine holder 300 to be inserted into the garment pocket 800 while simultaneously substantially preventing its inadvertent removal from the garment pocket 800 and/or damage to the garment pocket 800 and/or garment pocket seam 810.

Though not illustrated, the magazine holder 300 of an embodiment may further include one or more features to detachably engage the magazine 600 to increase the security with which the magazine 600 may be held within the magazine cavity 360. For example, the magazine holder back 310 may include one or more features to clip, latch, and/or snap to and/or over the magazine 600 and/or the magazine floor plate 610. In an embodiment, the one or more features to detachably engage the magazine 600 to increase the security with which the magazine 600 may be held within the magazine cavity 360 may not simultaneously substantially interfere with the ease and/or ability with which the user may withdraw the magazine 600 from the magazine holder 300 when the magazine holder is inserted into and coupled to the garment pocket 800.

Further, though described with reference to a garment pocket 800 and a garment pocket seam 810, it is to be understood that the magazine holder 300 of an embodiment may be configured to couple to one or more additional or alternate surfaces, layers, materials, or the like. For example, while described with reference to a front pocket on a pair of jeans, the magazine holder 300 of an embodiment may insert into and couple to other pockets (e.g., front, rear, cargo, etc.) of pants, shorts, shirts, jackets, outwear, or any other type or style of garment. Further, the pocket may be located in a purse, backpack, briefcase, or the like. Further still, the magazine holder 300 may be configured to couple to and/or engage a waistband, a belt, or any other band worn by the user on substantially any part of their person and/or included in a garment worn by the user. For example, the band may be elastic or substantially inelastic. The band may be an elastic band of a sock or located adjacent to a sock, for example for an ankle holster. Alternately the elastic band may extend around the user's midsection above their waist for a small-of-the-back holster or any other type of wearable holsters separate from or substantially included in a wearable garment. The embodiments are not limited in this context.

In operation, a user may first insert a magazine 600 into the magazine holder 300 of an embodiment. The magazine 600 may be at least partially or fully loaded with ammunition cartridges. In an embodiment, the user may thereafter engage one or more latches, clips, snaps, other features, and/or a combination thereof to the magazine 600, magazine floor plate 610, and/or a combination thereof to substantially hold the magazine 600 within the magazine cavity 360. Alternately, the magazine 600 may removably insert into and remain in the magazine cavity 360 with friction. The user may then insert the magazine holder 300 of an embodiment into a garment pocket 800, for example the front pocket of a pair of jeans. In an embodiment, the user may insert the magazine holder 300 into the pocket for their off hand, or the hand opposite the primary shooting hand of the user. Accordingly, a primarily right handed user, who may shoot primarily with at least their right hand, may insert the magazine holder 300 into their left front jeans pocket so that they may retrieve the magazine 600 substantially without removing their primary shooting hand from their pistol or other firearm. In an embodiment, the magazine holder 300 may substantially conceal the magazine 600 within the garment pocket. When needed, the user may withdraw the magazine 600 from the magazine holder to reload.

Depending on the configuration of the magazine holder retainer 500, magazine holder retainer attachment 350, and/or the magazine holder catch 400, the user may interact with one or more of the above to substantially securely detachably engage the magazine holder 300 to the garment pocket 800. Referring to FIG. 9 in particular, in this and other embodiments, if the magazine holder retainer attachment 350 may allow rotation of the magazine holder retainer 500, the user may rotate the magazine holder retainer 500 so that it is no longer located adjacent the magazine holder catch 400. More specifically, the user may rotate the magazine holder retainer 500 so that it is no longer located adjacent the magazine holder back 310 after which the user may insert the magazine holder 300 into the garment pocket. The user may thereafter rotate the magazine holder retainer 500 back to its original position and/or orientation so that it may be located adjacent the magazine holder back 310 and/or the magazine holder catch 400. By rotating as such, the user may more easily insert the magazine holder 300 into the garment pocket 800 while increasing the security with which the magazine holder 300 will remain inserted into and detachably engaged to the garment pocket 800.

Alternatively, the magazine holder retainer 500 may be grasped and pulled away from, for example the garment pocket 800, so that the magazine holder 300 may be at least partially disengaged from the garment pocket 800. More specifically, the magazine holder retainer 500 may be pulled away from the magazine holder catch 400 so that both the magazine holder retainer 500 and the magazine holder catch 400 may at least partially disengage the garment pocket 800 disposed between the magazine holder retainer 500 and the magazine holder catch 400. Once the magazine holder 300 has been removed from the garment pocket 800, the user may release their grasp of the magazine holder retainer 500. In an embodiment, the magazine holder retainer 500 may thereafter spring back or otherwise return to its original location and/or configuration. In an embodiment, the magazine holder retainer 500 may include a shape and/or configuration to facilitate the user grasping it to engage the magazine holder 300 to and/or disengage the magazine holder 300 from, for example, the garment pocket 800.

The magazine holder 300 of an embodiment and the components thereof (e.g., the magazine holder back 310, the one or more magazine holder sides 330, the magazine holder front 320, the magazine holder bottom 340, and the magazine holder catch 510) may be formed of a variety of materials. For example, the magazine holder 300 may be at least substantially formed of aluminum, steel, titanium, glass fiber reinforced plastic, a glass fiber reinforced polymer, a carbon fiber reinforced plastic, a carbon fiber reinforced polymer, a plastic, a polymer, and/or a combination thereof. In an embodiment, the magazine holder 300 and the components thereof may be formed at least in part from KYDEX. In an embodiment, at least a portion of the magazine holder 300 and the components thereof may be integrally formed. In alternate embodiments, one or more of the components may be individually formed and coupled to and/or attached to at least one or more other components.

Further, the magazine holder retainer 500 of an embodiment may be formed from any durable, resilient, material that may enable the magazine holder 300 to substantially clip to, for example, a pocket as described above. For example, the magazine holder retainer 500 of an embodiment may be substantially formed from spring steel, titanium, or other durable, resilient metal. Alternately, the magazine holder retainer 500 of an embodiment may be at least substantially formed from glass fiber reinforced plastic, a glass fiber reinforced polymer, a carbon fiber reinforced plastic, a carbon fiber reinforced polymer, a plastic, a polymer, and/or a combination thereof. In an embodiment, at least a portion of the magazine holder 300 and the magazine holder retainer 500 may be individually formed and thereafter coupled to each other and/or attached together for example with the magazine holder retainer attachment 350. In alternate embodiments, at least a portion of the magazine holder 300 and the magazine holder retainer 500 may be integrally formed In an embodiment, the material forming at least a portion of the magazine holder 300 may be shaped, textured, and/or otherwise configured to improve the operation of the magazine holder 300 as described above. In addition to functionality, the material forming at least a portion of the magazine holder 300 may be shaped, textured, and/or otherwise configured to improve the aesthetics of the magazine holder. Moreover, the magazine holder 300 of an embodiment may include engraving, molding, printing, or the like of text and/or graphics that may personalize the magazine holder 300 and/or indicate the manufacturer and/or model of firearm for which the magazine holder 300 may be specifically designed and/or configured. For example, the magazine holder 300 of an embodiment may include one or more engraved, molded, and/or printed (or a combination thereof) logos that may identify the manufacturer and/or model for which the magazine holder 300 may be designed and/or configured, the retailer selling the magazine holder 300, or any other naming, marking, design, and/or combination thereof. The embodiments are not limited in this context.

Figure 10:
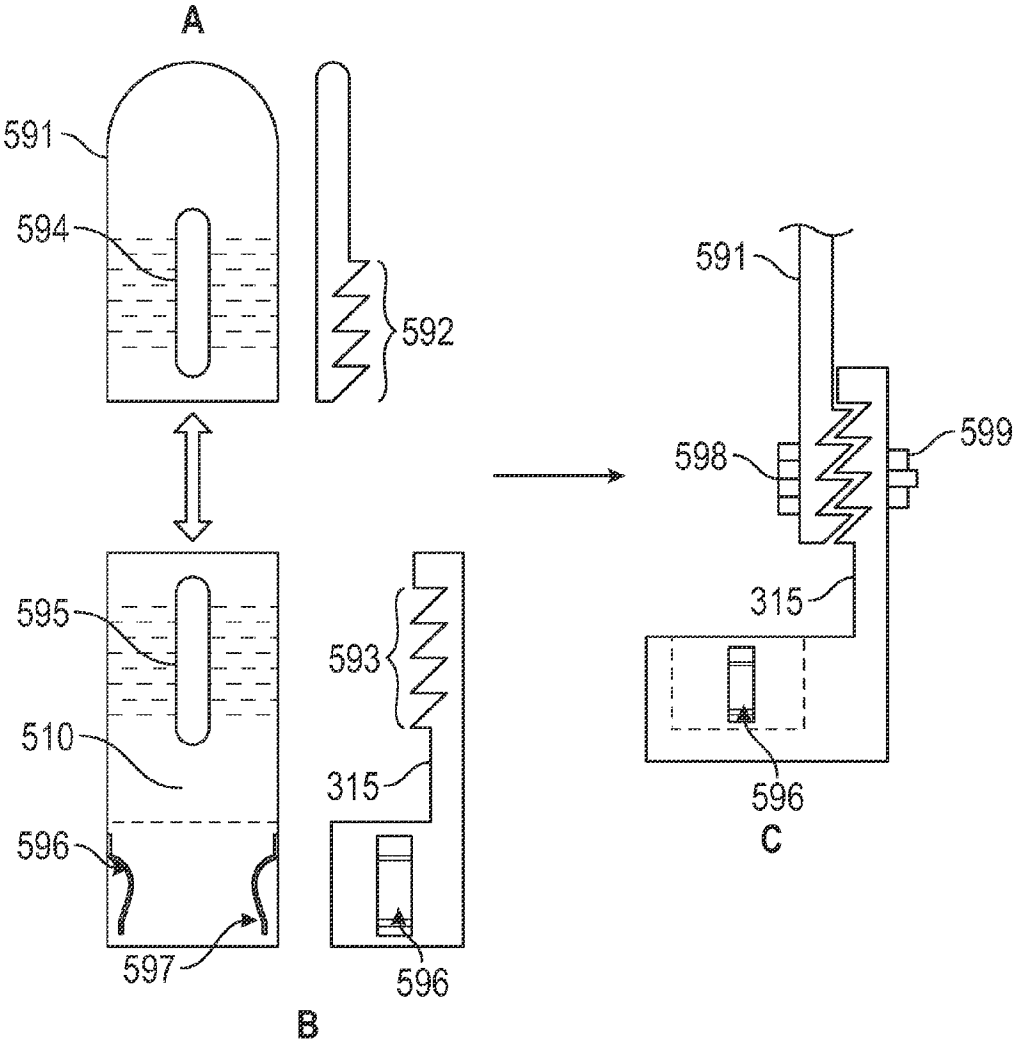
FIG. 10 illustrates a concealable firearm magazine holder having an adjustable height, according to one embodiment.

In one embodiment, magazine holder back 310 can be adjustable in height to accommodate various sizes of firearm magazines. For example, referring now to FIG. 10, in this embodiment, the magazine holder back 310 includes a detachable upper plate member 591 (A) having a bottom portion thereof that includes a plurality of saw-toothed edges 592 as illustrated. In this embodiment, a top portion of the magazine holder back front side 315 includes a plurality of saw-toothed edges 593 correspondingly matched to engage saw-toothed edges 592 of the upper plate member 591 (B). The overall height of the magazine holder back 310 can therefore be adjusted by placing the saw-toothed portions 591, 592 in a desired confrontation configuration. In this embodiment, the upper plate member 591 and the magazine holder back 310 include substantially matching slots 594, 595, respectively, to provide a pathway for a securing member to pass therethrough and hold the upper plate member 591 and the magazine holder back 310 in a desired configuration. In this embodiment, the securing member is illustrated as a cooperating bolt 598 and nut 599 combination; however, any other type of securing mechanism or method can be substituted.

In this embodiment, each magazine holder side 330 is configured with a flat retaining spring 596, 597, respectively, each oriented such that a spring end protrudes toward the middle of the magazine chamber 360. The flat retaining spring can be configured to assist in holding the firearm magazine in place, within the magazine chamber.

Figure 11:
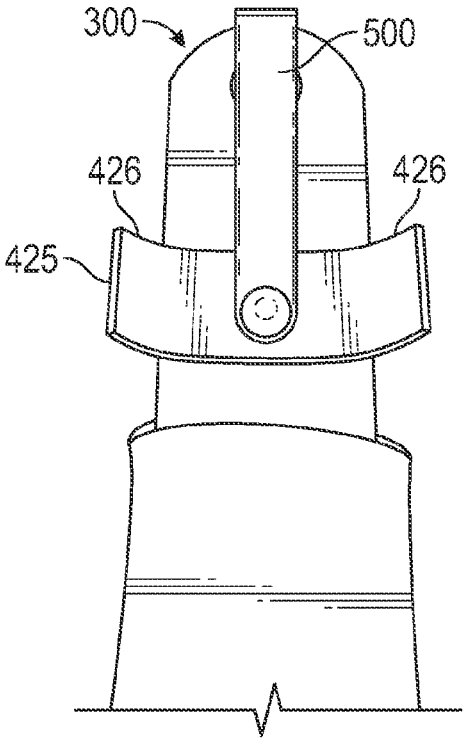
FIG. 11 illustrates a concealable firearm magazine holder having an alternative catch configuration, according to one embodiment.
Figure 12:
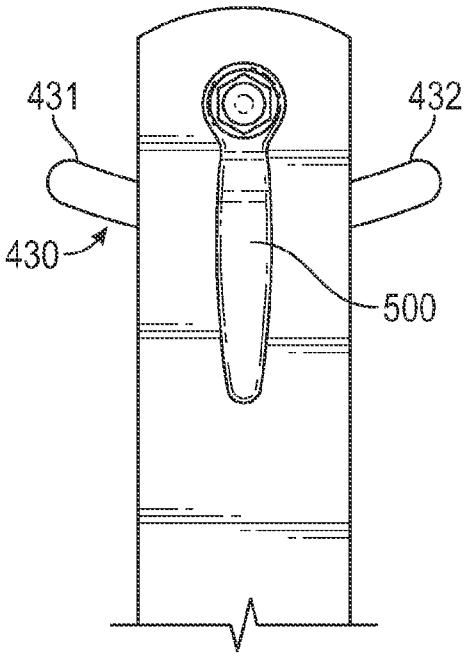
FIG. 12 illustrates a concealable firearm magazine holder having a second alternative catch configuration according to one embodiment.

In general, the catch of the firearm magazine holder 300 can be designed or configured in any way so as to maximize the confrontation of the catch with a pocket seam 810, so that when the firearm magazine is withdrawn from the holder 300, the catch catches on the seam and substantially prevents the holder 300 from being withdrawn from the pocket. Referring now to FIGS. 11 and 12, two alternative embodiments of a catch are illustrated. Referring first to FIG. 11, in this embodiment, the catch 425 includes a rectangular bar member that is curved on each end. In this embodiment, when the holder 300 is placed in a pocket, a top surface portion 426 of the catch can engage a pocket seam (e.g., seam 810). In such a configuration, the magazine holder retainer 500 can urge the fabric of the pocket and the seam toward the catch 425 which can serve to further secure the holder 300 in the pocket and substantially prevent its withdrawal when the firearm magazine is removed by the user.

FIG. 12 illustrates a second alternative embodiment of a catch. In this embodiment, the catch magazine holder catch 430 includes a first tab member 431 and a second tab member 432 that extend from the magazine holder back 310. In this embodiment, each tab member 431, 432 is slightly curved to help facilitate engagement of the catch 430 with a pocket seam 810 when disposed in a pocket for concealment. In this embodiment, the tap members 431, 432 include rounded edges which can reduce the likelihood of tearing the material of the pocket.

A number of illustrative embodiments have been described. Nevertheless, it will be understood that various modifications may be made without departing from the spirit and scope of the various embodiments presented herein. Accordingly, other embodiments are within the scope of the following claims.

WHAT IS CLAIMED IS:

1. A firearm magazine holder comprising:

a back having an upper portion and a lower portion, at least one side coupled to the back, a front coupled to the at least one side, and a bottom coupled to the lower portion of the back, the at least one side, the front, or a combination thereof;

a retainer arm comprising a first end portion coupled to the upper portion of the back, and an elbow portion adjacent the first end portion; and an elongate catch disposed on the back adjacent the elbow portion;

wherein the catch extends across the width of the back exclusive of a centrally-located notch having a notch width at least as wide as a width of the elbow portion of the retainer arm; and wherein the catch is oriented perpendicular to the retainer arm and comprises at least one flat facet side extending from the back.

2. The firearm magazine holder of claim 1, further comprising a retainer attachment to couple the retainer arm to the back.

3. The firearm magazine holder of claim 1, further comprising a rotating retainer attachment to couple the retainer arm to the back and to allow rotation between the retainer arm and the back.

4. The firearm magazine holder of claim 1, wherein the retainer arm and the elongate catch are configured to detachably engage a garment layer.

5. The firearm magazine holder of claim 1, wherein the retainer arm is configured to detachably engage a first side of a garment layer and wherein the elongate catch is configured to detachably engage a second side of the garment layer.

6. The firearm magazine holder of claim 5, wherein the retainer arm is configured to detachably engage the first side of the garment layer and the elongate catch is configured to detachably engage the second side of the garment layer at a same region of the garment layer.

7. The firearm magazine holder of claim 1, wherein the elongate catch further comprises at least one of a protrusion, an extension, a texture, or a feature coupled to the back.

8. The firearm magazine holder of claim 1, wherein the elongate catch comprises a long axis and further comprises a triangular cross-section in a plane bisecting the long axis.

9. The firearm magazine holder of claim 7, wherein the protrusion has a triangular shape.

10. A method for making a substantially concealable firearm magazine holder, comprising:

coupling at least one side member to a back member having an upper portion and a lower portion, a front member to the at least one side member, and a bottom member to the lower portion of the back member, the at least one side member and the front member to form a magazine holder;

coupling or integrally forming a first end portion of a retainer arm to the upper portion of the back member, wherein the retainer arm comprises an elbow portion or is formed to comprise an elbow portion adjacent the first end portion; and coupling an elongate catch to, or integrally forming a catch on the back member proximal to the elbow portion, wherein the elongate catch extends across the width of the back, exclusive of a centrally-located notch having a notch width at least as wide as a width of the elbow portion of the retainer arm.

11. The method of claim 10, wherein the first end portion of the retainer arm is rotatably coupled to the back member.

12. The method of claim 11, wherein the retainer arm is flexible to provide the capability of detachably engaging a portion of a garment pocket with the retainer and the elongate catch in the same location.

13. A concealable firearm magazine holder, comprising:

a back having an upper portion and a lower portion, at least one side, a front, and a bottom;

a magazine cavity defined by the back, the at least one side, the front, and the bottom, wherein the bottom is in contact with or adjacent to the lower portion of the back;

an elongate clip arm having a first end portion coupled to the upper portion of the back, the clip arm comprising an elbow portion adjacent the first end; and an elongate catch protruding from the back perpendicular to the clip arm and positioned adjacent the elbow portion, wherein the elongate catch comprises a centrally-located notch having a notch width at least as wide as a width of the elbow portion of the retainer arm.

14. The concealable firearm magazine holder of claim 13, wherein the clip arm and the elongate catch are configured to cooperatively detachably engage a garment pocket.

15. The concealable firearm magazine holder of claim 13, wherein the magazine cavity is configured to accept a firearm magazine inserted therein; and wherein the magazine cavity is further configured to substantially fully enclose an ammunition cartridge removably inserted into the firearm magazine.

16. The concealable firearm magazine holder of claim 15, wherein the concealable firearm magazine holder is composed of aluminum, glass fiber reinforced plastic, a glass fiber reinforced polymer, a carbon fiber reinforced plastic, a carbon fiber reinforced polymer, a plastic, a polymer, KYDEX, or a combination thereof.

17. The concealable firearm magazine holder of claim 13, wherein at least the back and the elongate catch are integrally formed.

18. The concealable firearm magazine holder of claim 13, wherein the elongate catch has a triangular cross-section in a plane bisecting the long axis of the elongate catch.

19. The concealable firearm magazine holder of claim 13, wherein the elongate catch comprises at least one triangular protrusion having an edge that is substantially perpendicular to a long axis of the back.

20. A method for making a concealment article for a firearm magazine, comprising:

providing a back having an upper portion and a lower portion, at least one side coupled to the back, a front coupled to the at least one side, and a bottom coupled to the lower portion of the back, the at least one side, the front, or a combination thereof to form the concealment article configured for the firearm magazine;

coupling a first end portion of a retainer having an elbow adjacent the first end portion to the upper portion of the back; and coupling or integrally forming an elongate catch to the back, adjacent the elbow and oriented perpendicular to the retainer, wherein the elongate catch comprises a centrally-located notch having a notch width at least as wide as a width of the elbow portion of the retainer arm and at least one flat facet side protruding from the back toward the retainer.

* * * * *